United States Patent [19]

Lindquist et al.

[11] Patent Number: 4,515,631

[45] Date of Patent: May 7, 1985

[54] METHOD FOR PRODUCING BLISTER COPPER

[75] Inventors: Björn K. V. Lindquist; Stig A. Petersson, both of Skelleftehamn, Sweden

[73] Assignee: Boliden Aktiebolag, Stockholm, Sweden

[21] Appl. No.: 580,614

[22] Filed: Feb. 16, 1984

[30] Foreign Application Priority Data

Mar. 4, 1983 [SE] Sweden ..... 8301187

[51] Int. Cl.[3] ..... C22B 15/06

[52] U.S. Cl. ..... 75/73

[58] Field of Search ..... 75/73, 72, 74, 75, 23

[56] References Cited

U.S. PATENT DOCUMENTS

| | | | |
|---|---|---|---|
| 3,281,236 | 10/1966 | Meissner | 75/73 |
| 3,669,646 | 6/1972 | Cullom | 75/74 |
| 4,030,915 | 6/1977 | Aaltonen et al. | 75/74 |
| 4,072,507 | 2/1978 | Rajcevic et al. | 75/74 |
| 4,144,055 | 3/1979 | Petersson et al. | 75/73 |

FOREIGN PATENT DOCUMENTS 88680 3/1937 Sweden .

*Primary Examiner*—M. J. Andrews
*Attorney, Agent, or Firm*—Nils H. Ljungman

[57] ABSTRACT

The invention relates to a method for producing blister copper from copper-iron sulphide concentrates, and particularly from concentrates whose sulphur content is insufficient to effect autogenous smelting of the concentrates to matte. The invention is characterized in that the concentrate, together with slag former, is smelted with oxygen-gas or air rich in oxygen in a top blown rotary converter, to form a mixture of a contaminated copper metal phase, magnetite and fayalite slag, whereafter a reductant, preferably coke, is supplied for the reduction of magnetite while supplying heat. After the reduction process, the slag is separated from the formed copper metal phase, which is then refined to blister copper in a manner known per se.

In this respect, a preferred method of refining the copper metal phase, or black copper, is to refine the black copper, subsequent to separating the slag, in the converter by an oxidizing process with the addition of a further slag former, to form blister copper and a slag containing oxidized impurities from the ingoing copper metal phase.

4 Claims, 1 Drawing Figure

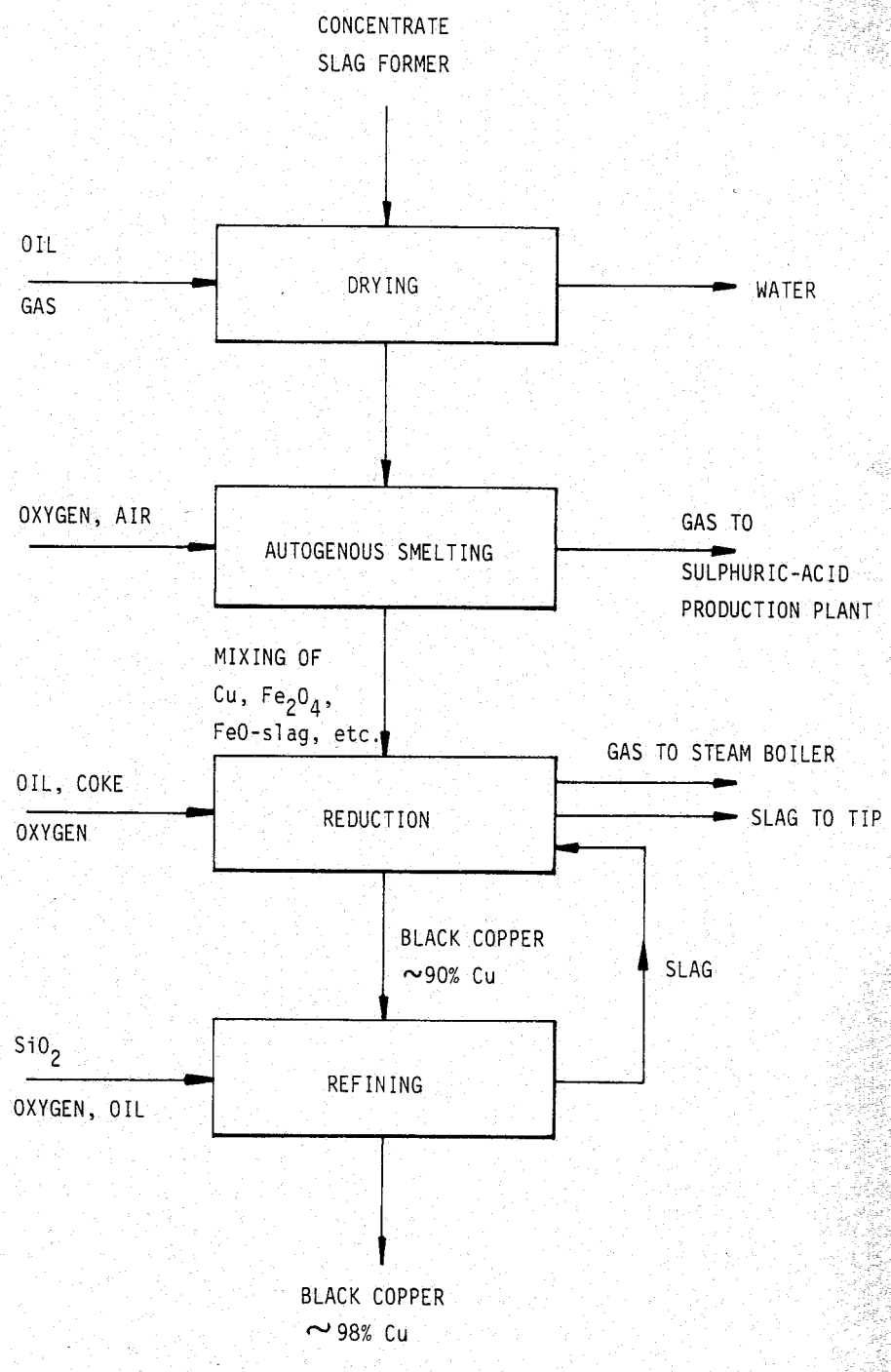
CONCENTRATE
SLAG FORMER
OIL
GAS
DRYING
WATER
OXYGEN, AIR
AUTOGENOUS SMELTING
GAS TO
SULPHURIC-ACID
PRODUCTION PLANT
MIXING OF
Cu, $Fe_2O_4$,
FeO-slag, etc.
GAS TO STEAM BOILER
OIL, COKE
OXYGEN
REDUCTION
SLAG TO TIP
BLACK COPPER
~90% Cu
SLAG
$SiO_2$
OXYGEN, OIL
REFINING
BLACK COPPER
~98% Cu

METHOD FOR PRODUCING BLISTER COPPER

The present invention relates to a method for producing blister copper from copper-iron sulphide concentrates, particularly concentrates in which the amount of sulphur present therein is insufficient to obtain autogenous smelting of the concentrate to matte.

Blister copper is produced mainly from sulphidic copper materials containing iron, the methods applied heretofore comprising three stages, which incorporate: partial roasting of the raw material; smelting of the partially roasted raw material in the presence of a slagging agent to form matte and slag; and finally convertion of the molten matte, by blowing thereinto a gas rich in oxygen, normally air, while at the same time slagging iron oxides, by adding acid slagging agents, normally silica. In the partial roasting stage, in which the sulphidic copper material is heated through the oxidation of the sulphur present as oxygen is introduced, the sulphur content of the roasted material is adapted so that sufficient sulphur is found to form a matte of desired copper content in the subsequent smelting process. The matte normally contains from 30–50% copper and from 22–26% sulphur. Naturally, the chemical composition of the matte will vary from case to case, in dependence upon the raw material used and the extent to which said material is roasted. The values aforegiven, however, are representative of matte produced from the most common of the copper raw materials.

During the smelting process there is formed, in addition to matte, an iron-containing slag, which is given a suitable composition by adding silica and, in certain instances, minor quantities of lime, so that the slag is more fluid. The slag, which normally contains about 0.4–0.8% copper, is tapped-off and dumped. In certain cases, the slag will also contain significant quantities of zinc and other valuable metals, which can be recovered in slag fuming processes.

In conventional smelting processes, the copper content of the matte is regulated to 30–40%, since a higher copper content results in more copper in the slag, which in turn results in unacceptable copper losses. One disadvantage with these conventional smelting processes, is that the concentrates must first be partially roasted in a separate unit to an extent adjusted to the smelting process, and must then be smelted down to matte in a further stage, it being necessary in turn to transfer the matte to a converter, in which it is refined to blister copper. This means that many apparatus units must be provided, and also present related problems with respect to transportation of the material between the units. Consequently, there have been developed in later years smelting units in which a copper concentrate can be smelted directly, and in which the heat supplied to the process consists of the heat of combustion of the sulphur present in the copper raw material. This is known as autogenous smelting. A furnace used for autogenous smelting processes is the so-called flash smelter, which in principle comprises a vertically arranged reaction shaft, a horizontally arranged settling section for the smelt, and a waste-gas section. Preheated air and dried copper concentrate are introduced into the top of the reaction shaft. The exothermic reaction takes place in the shaft between the oxygen in said air and the sulphur in the copper concentrate, the particles reaching their melting temperature and falling down into the settling section, where they form a molten bath comprising copper matte and slag. Such furnaces are normally tapped by continuously removing the slag, while the copper matte is tapped discontinuously. The copper content of the matte can be regulated, by controlling the amount of oxygen supplied, and normally lies at about 60% copper, the slag containing 0.8–2.0% copper. For the sake of economy, it is necessary to process the slag further in additional process stages, to reduce the copper content of said slag.

In addition to the aforementioned type of furnace (Outokumpu) there are also found furnaces of the INCO type, which operate in accordance with the same principle but have the major difference that while the Outokumpu-furnaces use preheated air when melting the concentrate in the shaft, the INCO-furnaces uses air rich in oxygen and does not employ a flame shaft.

In accordance with our earlier Swedish Pat. No. SE-B-7603238-2, blister copper is produced by the autogenous smelting of sulphidic copper raw material in a rotary converter, in the presence of oxygen and a slag former, and by converting the matte to blister copper. The raw material is smelted by supplying copper raw material, slag former and oxygen simultaneously to the converter, and by interrupting the supply of oxygen subsequent to charging at least 75% of the copper raw material, whereafter the smelt is treated with a reduction agent. The smelt is transferred batchwise to a holding furnace, where the matte and slag formed are separated from one another, whereafter the formed slag is reduced and tapped off, and the matte formed is transferred to a converter of any known type. In this case, the smelting unit used is preferably a top-blown rotary converter of the Kaldo type, in which flash smelting of copper concentrate is carried out. A Kaldo converter rotates at a speed such that material is entrained from the bath by the rotating wall, and is caused to fall down into said bath, there being maintained in this way a particularly effective contact between the bath and the gas-phase present thereabove. This enables the reactions to take place rapidly, and also enables rapid adjustment of the equilibrium between the various parts of the bath.

In the case of such autogenous smelting processes, it is normally necessary for the concentrates to contain relatively large quantities of sulphur, so that the heat generated during the partial oxidation of the sulphur is sufficient for forming a molten bath of matte and slag. This requirement has hitherto made it impossible to utilize autogenous smelting processes for many types of commercially available concentrates, particularly those concentrates where the sulphur content is low in relation to the copper content, and consequently which have a low energy content. To enable the autogenous smelting of such concentrates, it has previously been proposed to utilize the entire energy content, by smelting the concentrates directly to blister copper, although such processes have not hitherto been allotted any great significance, due to the extreme practical difficulties associated with such direct smelting processes. Thus, the slags formed in such smelting processes are highly viscous, due to the fact that the iron is not only oxidized to FeO, but also forms to a very large extent not-readily melted oxides, such as magnetite and spinel. It is consequently suggested in U.S. Pat. No. 4,030,915 (Outokumpu) that the raw material must be so low in iron as 3–4%. This proviso severely restricts the number of raw materials which can be worked-up by such an autogenous smelting process.

In addition to the difficulties encountered with the technical aspects of the process in handling viscous slags, the slags obtain elevated contents of copper, which gives rise to unacceptable metal losses.

It has now surprisingly been found possible to produce blister copper directly, by the autogenous smelting of copper-iron sulphide concentrates, without encountering the difficulties and problems referred to in the introduction. Accordingly, the method is characterized by the features set forth in the following claims.

By smelting concentrate in accordance with the invention, with oxygen gas or air rich in oxygen, together with a slag former in a top blown rotary converter, and then reducing the formed magnetite, it is possible to obtain a fayalite slag $2FeO.SiO_2$ having a low magnetite content. This results in black copper, i.e. a contaminated copper metal phase having a sulphur content reaching towards the equilibrium content for the miscibility gap in the copper-sulphur system. Normally, the black copper has a sulphur content of from 1 to 3%, some percent iron and lead, nickel and other impurities alloyed with copper. The copper content is normally about 90%.

Subsequent to separating out the fayalite slag, the black copper can be refined to blister copper in some suitable known manner. It is preferred, however, to effect this refinement in the rotary converter, by oxidation with oxygen or an oxygen-containing gas while supplying heat. The slag former used is suitably $SiO_2$. The slag formed can be allowed to remain in the converter, and constitutes one of the starting materials in the preceding reduction phase. Alternatively, the black copper can be refined to blister copper in a separate furnace, for example an anode furnace, the slag formed during the refining process being returned to the converter.

An interesting application of the process according to the invention is for working-up extremely iron-rich copper sulphide concentrates, including copper-containing pyrites. The iron content of such materials may be up to about 45% and even thereabove. The iron-rich material is first smelted to form a copper metal phase and fayalite slag in accordance with the invention.

Then the formed fayalite slag is separated from the copper metal phase, which is refined to blister copper, whereas the fayalite slag is reduced to form metallic iron. Thus, the present process may be employed as the first stage of the two-stage process disclosed in U.S. Pat. No. 4,304,595. In said reference any nonferrous metal present in the raw material is suggested to be maintained combined with sulphur as a matte which is removed before the slag reduction. Thus, the present method will provide a more favourable way, employed as the first stage in those cases, when the raw material contains copper as the main nonferrous element present.

BRIEF DESCRIPTION OF THE DRAWING

The drawing is a block schematic of a preferred embodiment of the method according to the invention, and partly to a working example.

The invention will now be described in more detail, partly with reference to the accompanying drawing.

As illustrated in the block schematic of the preferred embodiment, the concentrate is firstly dried together with the necessary slag former, so as to contain the least possible amount of moisture. Normally, the concentrates are maintained at a moisture content of from 5–10%, in order to facilitate handling of the concentrates and to reduce the amount of dust created when transporting and storing said concentrates. The dried mixture is introduced, together with oxygen gas or air rich in oxygen, into the rotary converter through a lance, and is smelted autogenously to form a mixture of an impure copper metal phase (black copper), magnetite and FeO-containing slag, and during the generation of a gas having a high sulphur-dioxide content, this gas suitably being passed to a contact plant for producing sulphuric acid. Subsequent to introducing the entire charge into the converter and smelting said charge therein, a reduction agent is added, substantially continuously, and reduction of the charge is carried out while supplying heat from an oil-oxygen burner. The reductant preferred is coke, although other solid reductants, for example sulphides and scrap iron, can be used. The gas generated contains large quantities of carbon monoxide, and is suitably combusted in the converter hood by supplying secondary air thereto. The gas is then suitably passed to a steam boiler, to produce steam. The slag formed is mainly fayalite, since the magnetite has been reduced substantially completely to FeO during the reduction stage. The slag can be dumped on a slag tip, when the copper content of the slag is at a level normal for dumped slag. Because the magnetite content of the slag is low, there is no risk of mechanical suspension of copper in the slag, which has now no elevated viscosity.

The black copper formed is refined, suitably in the same converter, by oxidizing the remaining impurities. This oxidation is suitably carried out with oxygen gas, while adding $SiO_2$ for slagging the resultant oxides of iron, lead and other oxidizable compounds. The resultant slag is returned to the reduction stage.

Thus, the method according to the present invention enables copper to be manufactured directly by the autogenous smelting of copper-iron sulphide concentrates, particularly concentrates which are poor in sulphur. By carrying out the autogenous smelting process in a rotary converter, the magnetite formed and other not-readily melted oxides will not disturb the process during smelting. Instead, these oxides as they are formed in the smelt can be permitted to adhere to the lining of the converter, and to there form a growing magnetite layer during the smelting phase, which contributes to extending the useful life of the lining.

During the reduction phase, however, the magnetite will be rapidly reduced to FeO and together with the charged slag former will re-form a fayalite slag of low magnetite content and normal viscosity.

EXAMPLE

A concentrate having the following composition:

Cu: 33.8%
Fe: 27.6%
S: 16.6%
$SiO_2$: 8.5%
$Al_2O_3$: 2.6%
CaO: 0.9% was charged to a top-blown rotary converter of the Kaldo type, in a quantity of 57.3 tons together with 7.4 tons of recycled products and 10.1 tons of silica. It was possible to carry out the smelting process at a smelting capacity of 360 kg concentrate per minute, i.e. 470 kg charge per minute. In this respect, 78.6 $Nm^3$/min of air enriched in oxygen, containing 65% $O_2$, was required to sustain autogenous smelting. Thus, the oxygen-gas requirement was 51 $Nm^3$/min during the smelting process. The total smelting time was 159 minutes. The smelting temperature was about 1200° C. 4517 $Nm^3$/h gas having 53% $SO_2$, 10% $O_2$ and the remainder mainly nitrogen were produced during the smelting process. The temperature of the gas was 1200° C. 2.3 tons of steam/hour could be produced from the gas in a downstream steam boiler, after which the gas, having a temperature of about 300° C., was passed to a gas scrubber and then to a plant for the manufacture of sulphuric acid.

When the entire charge had been made and smelted, coke was charged to the furnace substantially continuously in an amount of 41 kg/min. This represents a coke requirement corresponding to 60 kg per ton of slag. During the reduction process, which took 60 minutes, the charge was heated with an oil-oxygen gas burner. The oil requirement was 6 l/min, or 360 liters in total. The outgoing reduction gas, which reached to 95 $Nm^3$/min, had the following composition: 63% CO, 10% $H_2O$ and 27% $CO_2$. The carbon monoxide was combusted in the converter hood by supplying secondary air, and the combusted gas was passed to the steam boiler, in which 10.5 tons of steam were produced each hour.

Upon completion of the reduction process, 40.6 tons of slag were tapped off, the slag having a composition of 0.5% Cu, 39% Fe, 1% S, 36% $SiO_2$, 3.7% $Al_2O_3$ and 1.3% CaO. Subsequent to adding silica and oxygen, the black copper was refined by oxidation, to form 19.5 tons of blister copper with 98.5% Cu and a slag having 25% Cu, which slag was returned to the reduction stage in a subsequent charge. The blister copper formed was tapped from the converter into a ladle, for transport to an anode furnace. Tapping of the blister copper took 30 minutes.

We claim:

1. A method for producing blister copper from copper-iron sulphide concentrates, including concentrates whose sulphur contents are insufficient to autogenously smelt the concentrate to matte, characterized by autogenously smelting the concentrate, together with a slag former which contributes to forming a slag phase, with oxygen gas or air rich in oxygen in a top-blown rotary converter, to form a mixture of a black copper phase, magnetite and fayalite slag; subsequently charging a reductant to the furnace for the reduction of formed magnetite while supplying heat; separating the flag formed from the resultant copper metal phase; and by refining the copper metal phase to blister copper.

2. A method according to claim 1, characterized in that the reductant used is coke, solid sulphide or scrap iron.

3. A method according to claim 1, characterized by refining the copper metal phase, in said converter, subsequent to separating the slag therefrom, by an oxidizing process with the addition of a further slag former, thereby producing blister copper and a slag containing oxidized impurities from the ingoing copper metal phase.

4. A method according to claim 2, characterized by refining the copper metal phase in said converter, subsequent to separating the slag therefrom, by an oxidizing process with the addition of a further slag form, thereby producing blister copper and a slag containing oxidized impurities from the ingoing copper metal phase.

* * * * *